United States Patent [19]

Marchetti

[11] Patent Number: 4,590,736

[45] Date of Patent: May 27, 1986

[54] AUTOMATIC TAPING UNIT WITH IMPROVED CUTTING SYSTEM FOR CARTON SEALING MACHINES

[76] Inventor: Augusto Marchetti, Piazza Sicilia 7, 20146 Milano, Italy

[21] Appl. No.: 788,221

[22] Filed: Oct. 16, 1985

[30] Foreign Application Priority Data

Oct. 17, 1984 [IT] Italy ..... 23191 A/84

[51] Int. Cl.[4] ..... B65B 51/06; B65B 1/04

[52] U.S. Cl. ..... 53/137; 156/468; 156/530

[58] Field of Search ..... 53/137; 156/468, 475, 156/486, 493, 530; 493/117

[56] References Cited

U.S. PATENT DOCUMENTS 3,491,657 1/1970 Feigel ..... 53/137 X 3,915,786 10/1975 Collett ..... 493/117 X 4,061,526 12/1977 Warshaw ..... 53/137 X

*Primary Examiner*—John Sipos

*Attorney, Agent, or Firm*—Cushman, Darby & Cushman

[57] ABSTRACT

From a casing destined for the fixing to a sealing machine project, at rest, an inlet roller and an outlet roller, which the same carton to be sealed forces to return into the outline of the casing during their advancement from one to another end of the casing. To the inlet roller is supplied an adhesive tape, which the same carton picks up and causes to adhere to the front wall, the adjacent horizontal wall and the rear wall by means of said inlet and outlet rollers. A cutting blade is arranged between said inlet and outlet rollers and is provided with suitable actuating means, which cause it to carry out a rapid run of cutting of the adhesive tape after the rear wall of the carton has overcome the blade a prefixed length.

7 Claims, 15 Drawing Figures

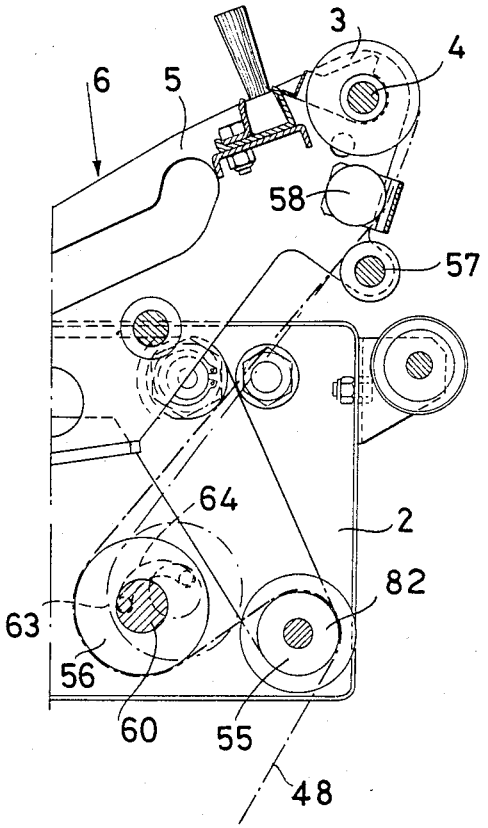
Fig. 6
Fig. 8
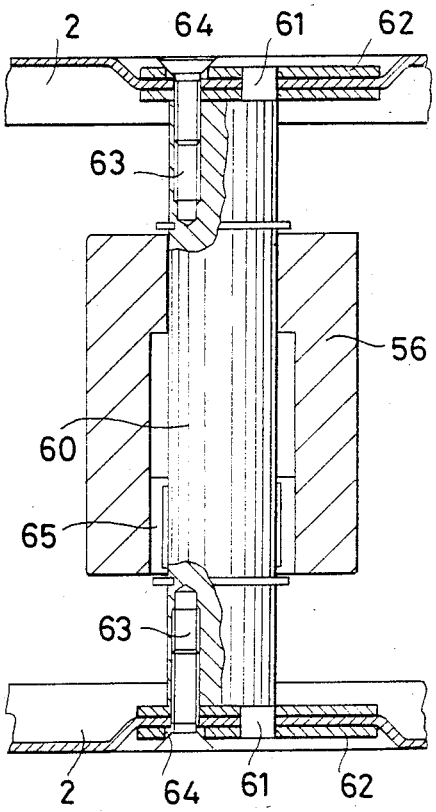
Fig. 7
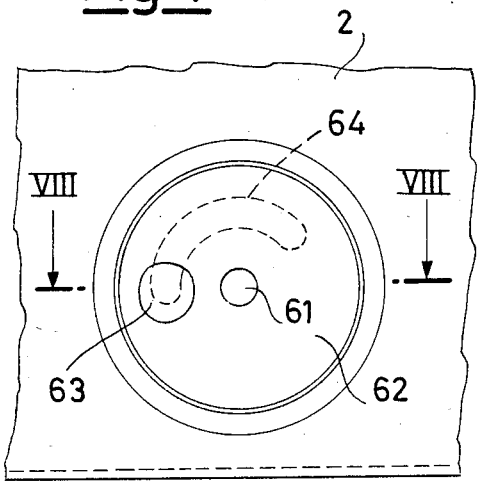

AUTOMATIC TAPING UNIT WITH IMPROVED CUTTING SYSTEM FOR CARTON SEALING MACHINES

The present invention relates to an automatic taping unit with improved cutting system for carton sealing machines.

There are known those sealing machines which apply adhesive sealing tapes along the top and the bottom of cartons, once the folding of their closing flaps has been operated.

To such end the above said machines employ automatic taping units arranged one below and the other above the advancement path of the cartons along a resting plane and suitably designed to allow the same carton to cause automatically the drawing, the cutting and the application of the correct length of tape.

Conventional taping units include two rubber-like applying rollers arranged one at the inlet and the other at the outlet of the taping unit and elastically urged to project from the outline of the casing of the taping unit and in the carton advancement path, but, on the other hand, capable of returning within the same outline during the passage of the cartons. A cutting blade is also arranged between the two said rollers with similar features of return and projection with respect to the casing of the taping unit.

The inlet roller has the function of causing an initial tape length to adhere to the front wall of the carton and then, once forced by the carton to return into the outline of the casing of the taping unit, of accompanying the following tape length, pulled by the carton, along the adjacent horizontal wall (top or bottom) of the carton and up to the rear wall of the latter. The outlet roller, once overcome by the carton and thus let project from the outline of the casing of the taping unit, has in its turn the function of causing a final tape length to adhere to the rear wall of the carton. The cutting blade, still after its overcoming by the advancing carton, has finally the function of carrying out the cutting of the tape between one carton and another, thereby fixing the length of said final tape length and that of the successive initial length for the following carton.

A problem of these taping units is connected to the disposition and the movement of the cutting blade, which have to be such as to grant the rapid and efficient cutting of the tape during working and at the same time to protect the operator at rest.

This having been considered, an object of the present invention is to realize an automatic taping unit for carton sealing machines, which shows features of high speed and cutting efficiency, so as to grant reliability and precision of operation in every working condition and with every kind of tape.

Another object of the present invention is then to realize a taping unit which provides for a suitable protection of the cutting blade during the rest condition.

In view of such objects the taping unit according to the invention, comprising a casing adapted to be fixed to a sealing machine along the carton advancement path, an inlet applying roller and an outlet applying roller elastically urged to project from said casing to be engaged and forced to return into said casing by the front of an advancing carbon, an adhesive taping supply arranged to put, at rest, a free end of the tape in contact with said inlet roller in order to be engaged and adhesively drawn forward by the carton front and further realized in such a way as to allow subsequently said tape to follow the drawing of said free end and to slide on said inlet roller to extend adhesively along the adjacent horizontal wall of the carton, and a cutting blade arranged between said inlet and outlet rollers and provided with actuating means capable of causing it to return into the outline of said casing before being reached by the carton front and to project from said outline for cutting the tape between said inlet and outlet rollers after having been overcome by the rear wall of the carton and before said horizontal wall of the carbon abandons said outlet roller, is characterized in that said actuating means of the cutting blade comprise first lever means pivoted on said casing and elastically urged to have an actuating portion projecting from said casing in order to be engaged and forced to return into said casing by said horizontal wall of the carton and second lever means which support said cutting blade and are pivoted on said first lever means and elastically urged with respect to the latter in such a way as to keep said cutting blade in the outline of said first lever means and to have an actuating portion projecting from said casing downstream of said actuating portion of the first lever means in the direction of advancement of the carton, the pivot between said first and second lever means being chosen in such a way that the releasing of said actuating portion of said first lever means by said horizontal wall of the carton while said actuating portion of the second lever means is still engaged by said horizontal wall of the carton causes the sudden projection of the cutting blade from the outline of said casing and said first lever means.

Otherwise stated, in the taping unit according to the invention the cutting blade is associated to a two-blade actuating mechanism, which is able at the cutting time to sum the effects of the rotation of the two levers to obtain an ample and, at the same time, rapid and precise cutting movement, which causes the abrupt cutting of the tape at the desired point between the two inlet and outlet rollers, and therefore between one carton and another.

With the taping unit at rest, on the other hand, the cutting blade remains inside the outline of its actuating mechanism, being safe from dangerous accidental contacts with the operator. For a better protection, on the other hand, it is easy to provide for the use of shielding members, for example simple rods, which may be fixed to the first lever means in suitable position.

The features of the present invention will be made more apparent by the following detailed description of an embodiment thereof, which is shown by way of non-limiting example in the enclosed drawings, in which:

FIG. 6 shows the detail of an initial adjustment of the adhesive tape supply, which is to be executed according to the intrinsic feature of the used tape;

FIG. 7 shows an enlarged view from outside of the device which allows said adjustment;

FIG. 8 shows said device in section along line VIII—VIII of FIG. 7;

Figure 1:
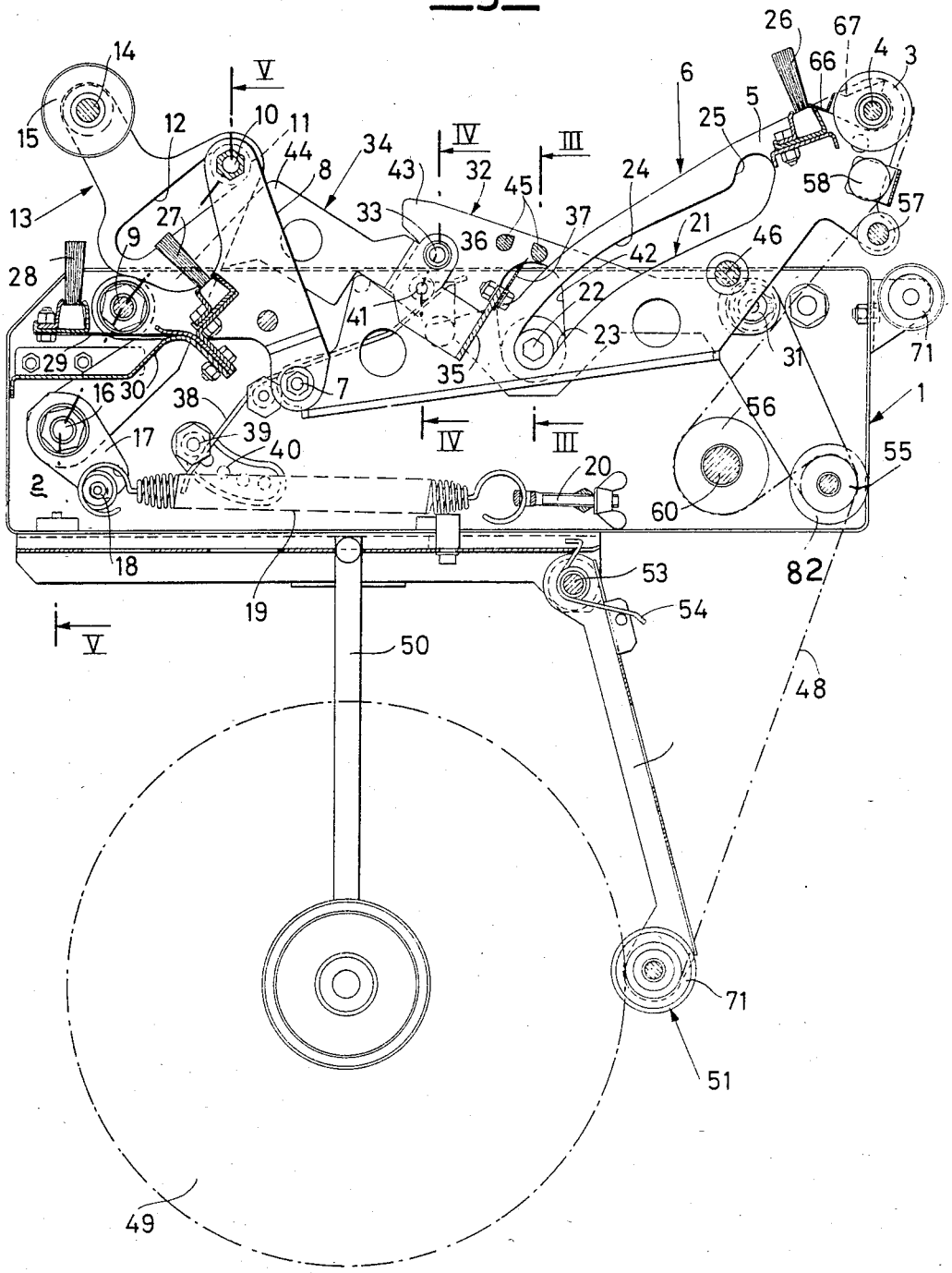
FIG. 1 shows in longitudinal section a taping unit according to the invention, arranged for the sealing of the carton bottom.
Figure 2:
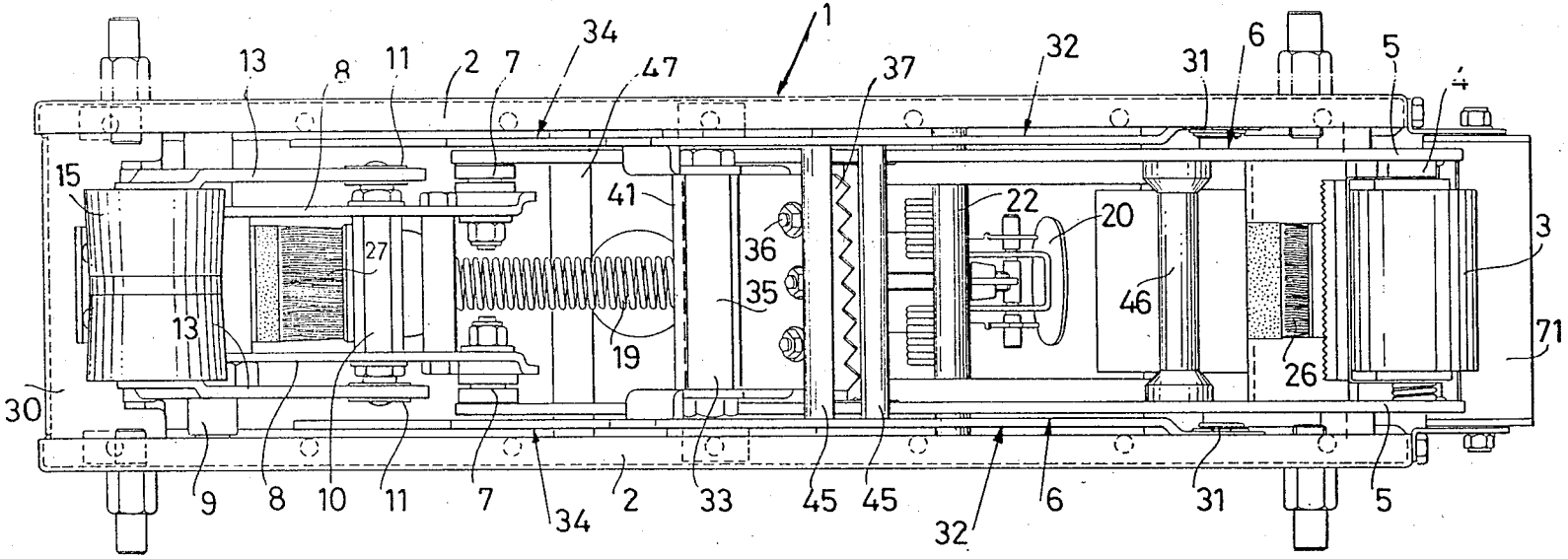
FIG. 2 shows said taping unit in top plan.
Figure 3:
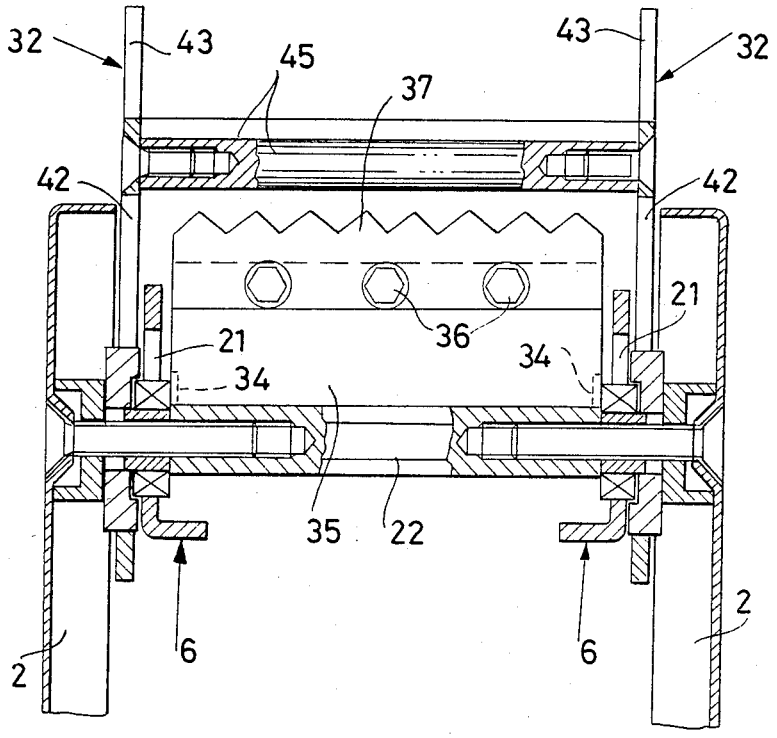
FIG. 3 shows an enlarged detail of said taping unit in cross section along line III—III of FIG. 1.
Figure 4:
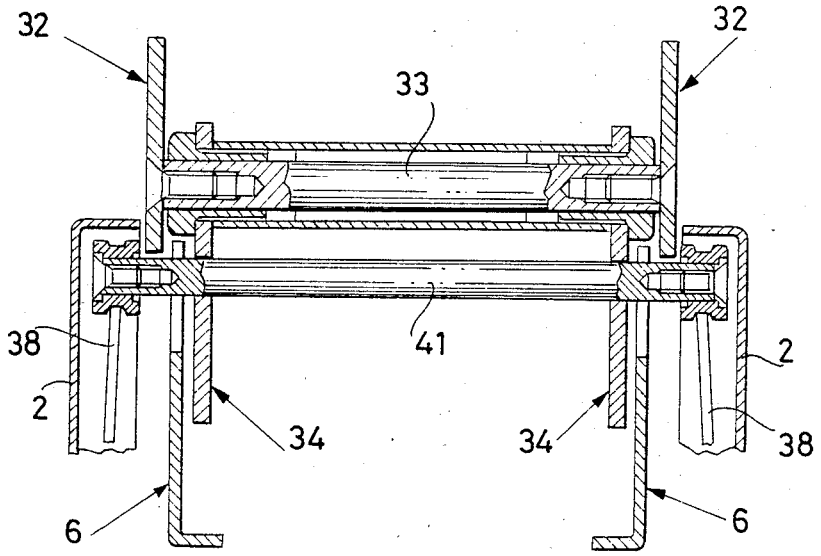
FIG. 4 shows another enlarged detail of said taping unit, in cross-section along line IV—IV of FIG. 1.
Figure 5:
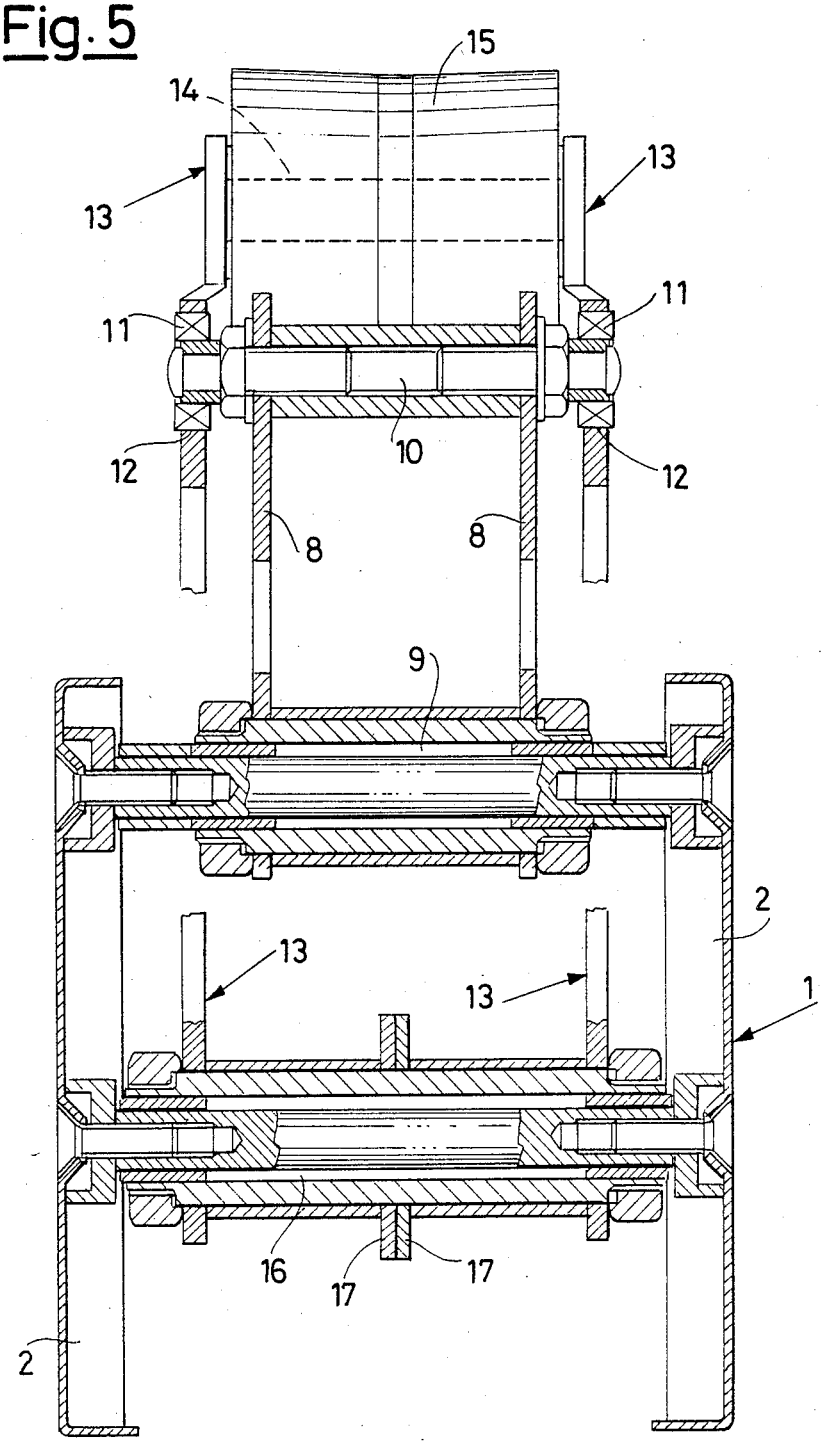
FIG. 5 shows further enlarged details of said taping unit, in section along line V—V of FIG. 1.

With reference to the general views of FIGS. 1 and 2, as well as to the partial sections of FIGS. 2 to 5, the taping unit shown in the drawings comprises a casing 1 formed by two parallel walls 2 (connected by cross-members 47), between which the several members and operating mechanism of the unit are housed and supported.

One of such members is a rubber-like applying inlet roller 3, which is rotatably mounted on pivot 4 arranged on a projecting end 5 of a pair of parallel arms 6, connected by cross-members 46 and having shaped windows 21 engaged with the fixed pivot 22. Another end of the arms 6 is hinged at 7 with a cooperating end of a pair of T-shaped levers 8 with fixed fulcrum 9 extending from one to another of the two sidewalls 2 of the casing 1. Another end of the T-shaped lever 8 in its turn is provided with a pin 10 with roller 11 slidingly inserted in rectilinear windows 12 of a pair of lever arms 13, which carry a support pivot 14 for a rubber-like applying outlet roller 15. The lever arms 13 have a fixed fulcrum 16, on which there are also mounted integrally with the lever arms 13 two adjacent crank arms 17, to which there is attached at 18 a spring 19 adjustably drawn by a screw clamp 20.

Thanks to said spring, the above said mechanism keeps the two inlet and outlet rollers 3 and 15 projecting from the outline of the casing 1, at the same time allowing both rollers to return into the same outline under the thrust of an advancing carton 59, the first roller following a path, firstly inclined with great slope, then inclined with less slope, then almost vertical, which is defined by corresponding lower, intermediate and upper portions 23, 24 and 25 of the shaped windows 21 and the second roller following a curved path with great radius, which is defined by the rotation of the lever arms 13 about the fixed fulcrum 16.

Two brushes 26 and 27 are fixed to the end 5 of the parallel arms 6 and to the T-shaped levers 8 for the purposes which will be described later. For the same purposes there is also provided a brush 28 mounted on a resilient blade 29 extending from a bracket 30 fixed to the casing 1.

Between the two sidewalls 2 of the casing 1 are also supported rotation pivots 31 for a first pair of levers 32, which have vertical windows 42 engaged by the fixed pivot 22 and on which is pivoted at 33 a second pair of levers 34, which carry a plate 35, on which a cutting blade 37 is fixed at 36. As can be seen particularly in FIG. 1, a pair of wire springs 38 with elastic load adjustable by means of a clamp 39 engageable with either one or the other of a plurality of selectable holes 40 extends along the sidewalls 2 of the casing 1 up to engage a horizontal pin 41 (FIG. 4) to urge upwards resiliently the pair of levers 34 and consequently, through the pivot 13, the other pair of levers 32. The choice of the length of the windows 42 and of the position of the pivot 33 is such that said resilient stress normally keeps an actuating portion 43 of the levers 32 and a similar actuating portion 44 of the levers 34 out of the outline of the casing 1; in such a condition, on the contrary, the cutting blade 37 remains within the outline of the pair of levers 32, hidden and protected by two shaped members 45, for example in the form of bars, integral with said levers 32.

To the above described mechanisms is associated an adhesive tape supplying system, which has the function of unwinding progressively an adhesive tape 48 from a roll 49 rotatably carried by an arm 50 extending downwards from the casing 1 (FIG. 1). With the roll 49 is engaged by pressure a pick-up and centering roller 51 (provided with sidewalls 71), which is rotatably carried by a lever arm 52 fulcrued at 53 on the casing 1 and subjected to the elastic stress of a spring 54. Once separated from the roll 49, the tape 48 passes around the pick-up and centering roller 51, thereby inverting its direction movement, and then arrives with its free end at the inlet roller 3, progressively passing around guide rollers 55, 56, 57 and 58.

Figure 12:
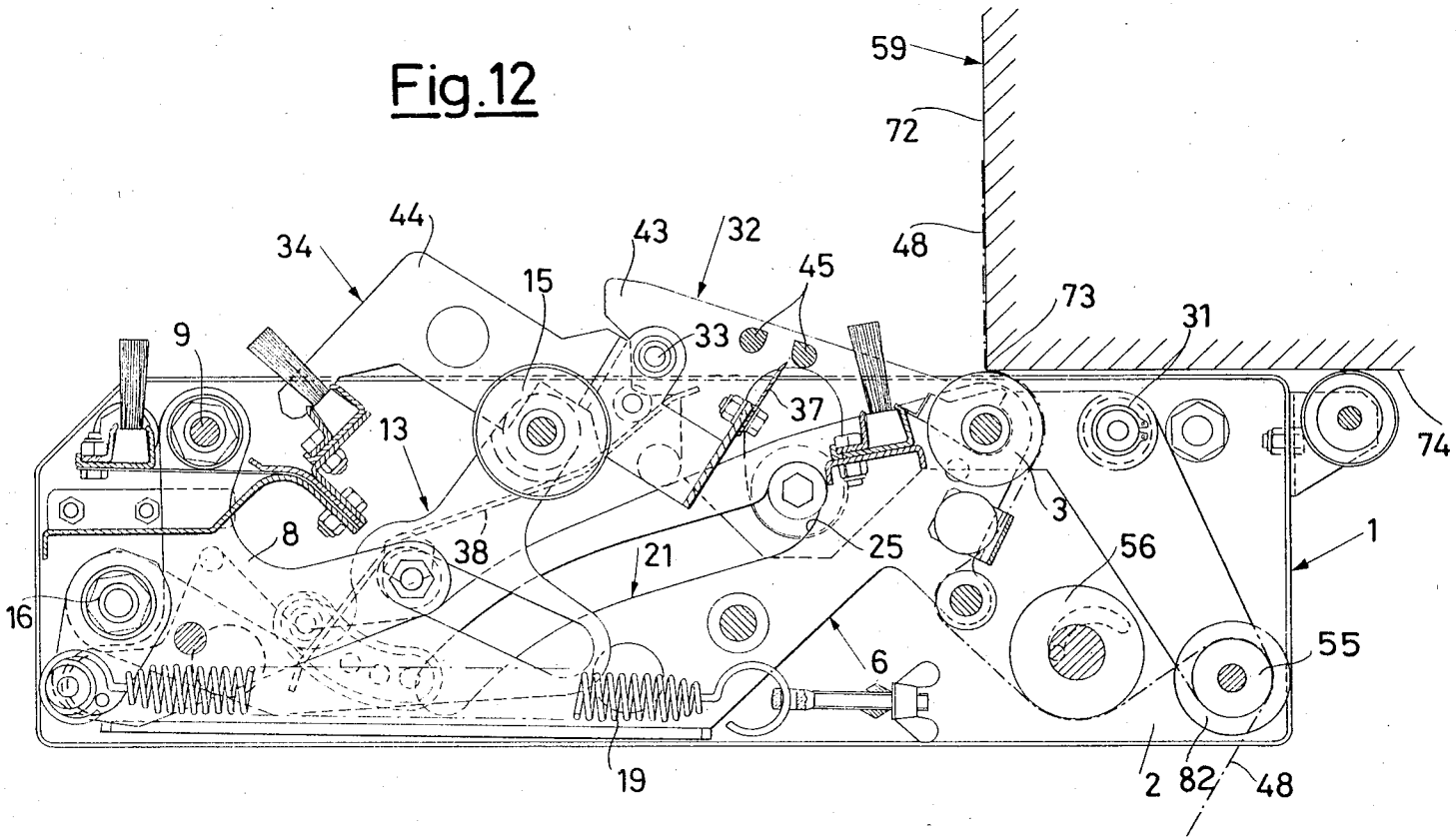
Figure 13:
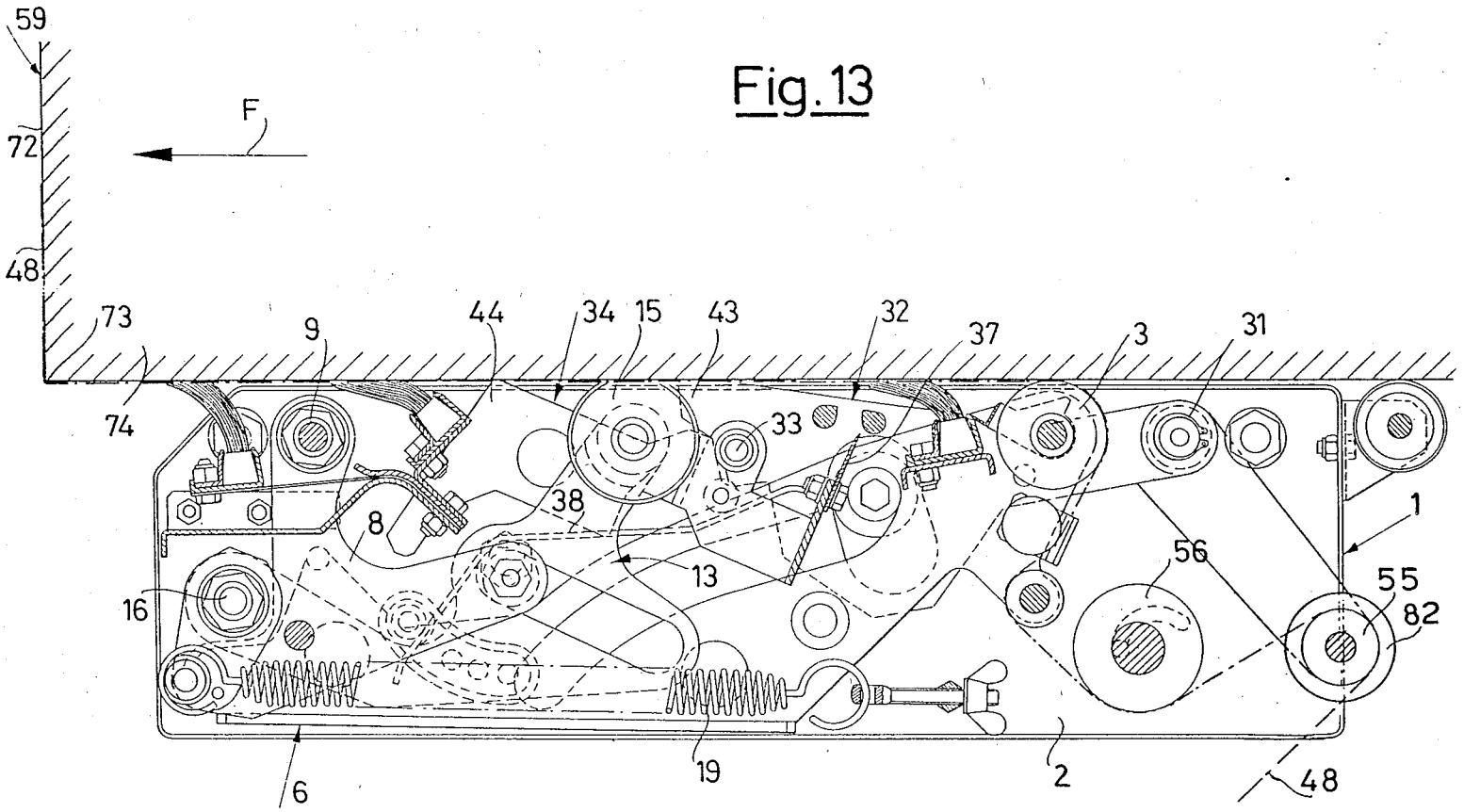
Figure 14:
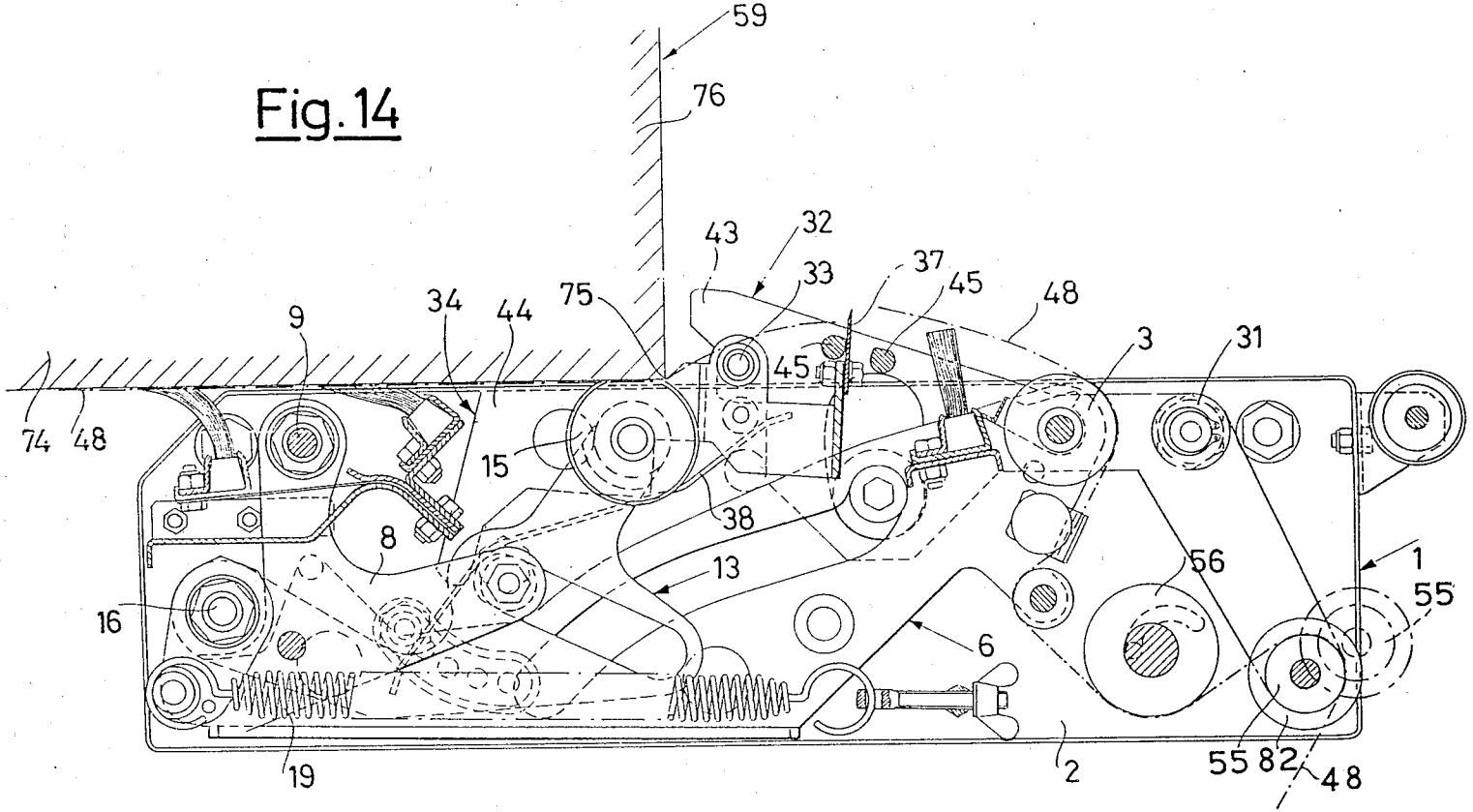

The guide roller 55 is provided with sidewalls 72 for tape centering purposes and is rotatably mounted on the pair of levers 32 in such a way as to be movable along a circular path having its center on the axis of the pivot 31, as evidenced in FIGS. 12, 13 and 14. The purpose and the result of this arrangement will be explained later.

The guide roller 56, of the one-way clutch type, is in its turn more advanced than the inlet roller 3 in the direction of advancement of the cartons to be sealed (arrow F in FIG. 11) and both the following guide rollers (57 and 58) are carried by the same lever arms 6 which carry the inlet roller 3 also. As evidenced in FIGS. 11 and 12 and as will be repeated later, this allows the inlet roller 3 to approach progressively the guide roller 56 during its movement of return into the outline of the casing 1 under the thrust of an advancing carton 59, thereby loosening the tape length between the rollers 56 and 3 up to the time of the complete disappearing of the inlet roller 3 (FIG. 12). In this way it is avoided the tensioning of the tape with the inlet roller 3 still engaged with the carton front and are thus avoided dangerous stresses of the carton under the double engagement of the inlet roller 3 urged to protrude outwards and of the tensioned tape 48 urged to resist the unwinding drawing from the roller 49.

The guide roller 56 has also the feature of being supported, through a free-wheel mechanism 65, by a support pivot 60 (FIG. 8), which is eccentrically mounted through trunnions 61 on the sidewalls 2 and at the center of rotatable disks 62, which are also fastened to the same pivot 60 by means of eccentric screws 63 passing through arcuated window 64 of the sidewalls 2 FIG. 7). The guide roller 56 may thus be selectively positioned in the position indicated in solid line in FIG. 6 or in that indicated in dash-dot line in the same Figure or further in several intermediate positions between the two above said. The purpose of this adjustment of position will be made clear later. Of course, similar results may be obtained through a translation, rather than an eccentric rotation, of the pivot 60.

Finally the taping unit illustrated in the drawings is provided with a cutting device which allows the cutting and the initial arrangement of the free end of the tape in an exact position in contact with the roller 3.

Figure 9:
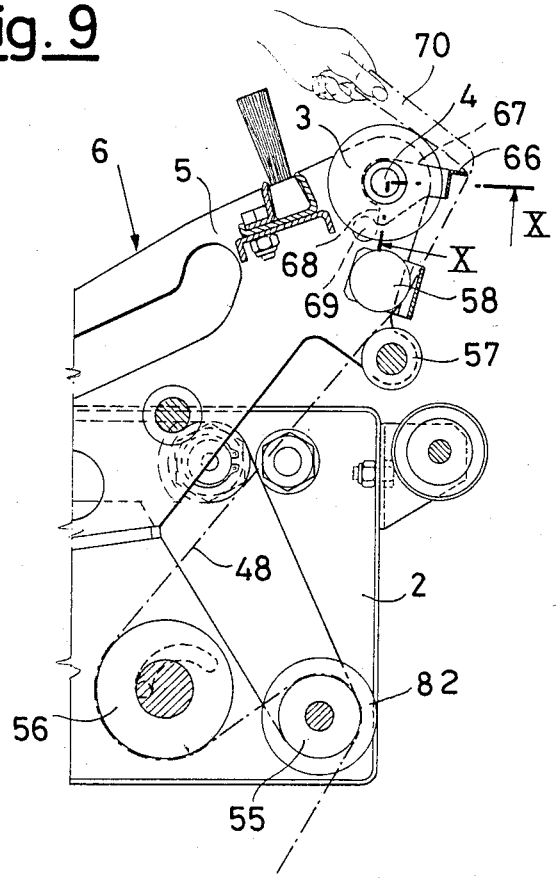
FIG. 9 shows the detail of an initial operation of cutting of the adhesive tape for the arrangement of its free end in suitable position for the execution of the successive sealing operations.
Figure 10:
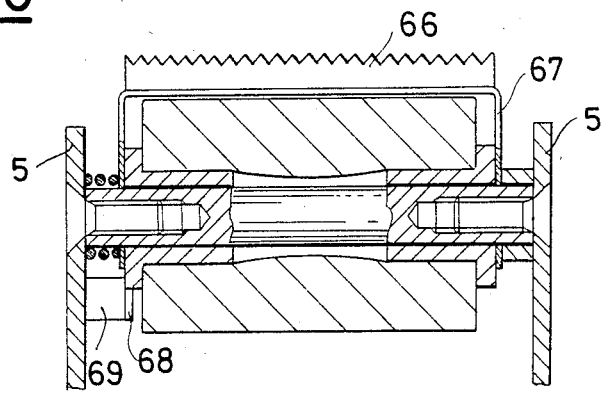
FIG. 10 shows the enlarged detail in section along line X—X of FIG. 9, of the device for carrying out said cutting.

As may be seen in FIGS. 1, 9 and 10, said cutting device comprises a cutting blade 66 supported by an inversed-U frame 67, which is rotatably supported by the same rotation pin 4 of the inlet roller 3. A projection 68 of the frame 67 is able to engage a stationary abutment 69 supported by the end 5 of one of the two lever arms 6 to define the cutting position of the blade 66, shown in FIG. 9. The rest position, on the contrary, is the diametrally opposed one of FIG. 1.

In order to understand the operation of the taping unit illustrated in the drawings, assume that the unit is inserted in a suitable space in the carton advancement plane in a sealing machine of known type. Still with all the several members and mechanisms in rest position as in FIG. 1, it is preliminarly carried out the positioning of the adhesive tape 48, by unwinding it from the roll 49, making it passing on the several pick-up and guide rollers 51, 55, 56, 57 and 58 and finally bringing the free end (initially provided with "leader extension" 70, FIG. 9) near the inlet roller 3. The cutting blade 66 is then arranged in the cutting position of FIG. 9, suitably chosen so that its distance from the working plane (corresponding to the top of the sidewalls 2 of the casing 1) is equal to the desired height of the tape length to be applied to the front wall of the cartons, and the cutting of the tape is manually executed. Having successively returned the blade 66 to the rest position of FIG. 1, the cut end of the tape is approached with its non-adhesive face to the inlet roller 3, as shown in FIG. 1. The taping unit is thus ready for the sealing operation.

The cartons to be sealed reach the taping unit by advancing, as known, on a resting plane coplanar with the top of the casing 1. At the inlet of the taping unit the cartons further rest on a support roller 71 supported by the casing (FIG. 11) and then prosecute (FIGS. 12–14) along the top of the sidewalls 2.

The several mechanisms of the taping unit start operation when the front wall 72 of the first carton 59 reaches the inlet roller 3. At that point, the free end of the adhesive tape 48 adheres with its adhesive face to said wall of the carton, using to this end the resistance of the inlet roller to the advancement of the carton.

While the advancement of the cartons prosecutes, a longer and longer length of adhesive tape adheres to the front of the cartons, approaching the lower front corner 73 (FIG. 11), and at the same time the inlet applying roller 3 is thrusted forwards by the advancing carton and caused to run, against the resistance of the spring 19, an initially very inclined withdrawal path defined by the portion 23 of the shaped windows 21 of the support arms 6 and then a less inclined withdrawal path defined by the portion 24 of the same windows 21; in this way, the inlet roller 3 firstly accompanies the initial length of tape along the front wall of the carton and then prosecutes the withdrawal movement, accompanying the advancement movement of the carton. Due to the kinematic connection of the support arms 6 with the T-shaped levers 8 and of the latter with the lever arms 13, the withdrawal movement of the inlet applying roller is accompanied by a simultaneous withdrawal movement of the outlet applying roller 15, carried out through the rotation of the lever arms 13 about the axis of the pivot 16.

Figure 11:
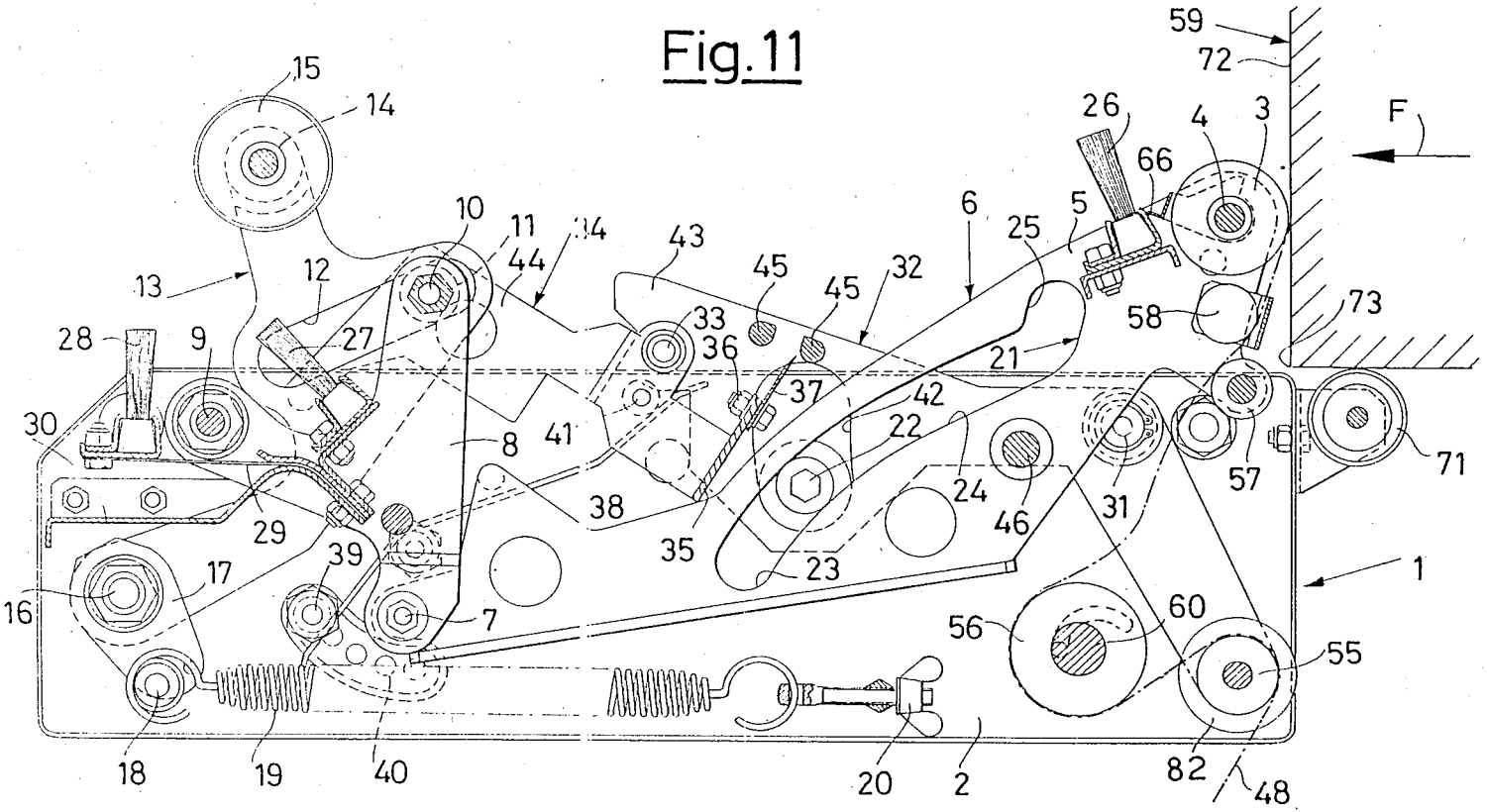
FIGS. 11 to 15 show views in longitudinal section of said taping unit during the passage of a carton to be sealed.

As may be seen in FIG. 11, the withdrawal movement of the inlet roller 3 causes a certain approachment of the same roller to the unidirectional guide roller 56, the result being that the length of adhesive tape interposed between the rollers 3 and 56 takes a loose condition which avoids any necessity for the advancing carton to win the resistance and therefore to suffer the stresses of a tensioned tape. A possible damage for the carton is thus avoided, as well as a possible sliding of the tape along the carton wall.

While the advancement of the carton still prosecutes (FIG. 12), the attachment of an initial length of tape to the front of the carton is completed and the inlet roller 3, still thrusted by the carton front, completes its withdrawal into the outline of the casing 1, accompanied, with circular path, by the outlet roller 13. Since the portion 25 of the shaped windows 21 of the support arms 6 is almost vertical, the last part of the withdrawal movement of the inlet roller is similarly almost vertical, thereby allowing the inlet roller to overcome rapidly the lower front corner 73 of the carton and to put itself under the lower or bottom wall 74 of the carton without creating in that step resistance with horizontal component which could cause "pointings" of the lower front corner 75 against the inlet roller 3 and therefore jamming and/or damages of the carton, especially in case of swelling of the carton bottom. Still in the latter step the carton draws the adhesive tape 48, retrieving the tape excess which caused the loose condition of FIG. 11 and tensioning the same tape.

The further advancement of the carton causes the progressive unwinding of the tape from the roll 49 due to the drawing exerted by the same carton. A longer and longer length of tape thus adheres to the lower or bottom wall of the carton (really constituted by four inwardly bent flaps to define a longitudinal center slit along which the sealing tape 48 is applied), suitably pressed by the outlet and inlet rollers 15 and 13, on which it slides freely and is further smoothed by the brushes 28, 27 and 26. The engagement of the carton bottom with the actuating portions 43 and 44 of the two pairs of levers 32 and 34 further causes in this step the complete withdrawal of said pairs of levers into the outline of the casing. This situation is illustrated in FIG. 13 and, due to the increased distance between the roller 55 supported by the pair of levers 32 and the stationary roller 56, results into a suitable tensioning of the tape 48 in the area between the inlet and outlet rollers 3 and 15.

Nothing happens when the carton bottom abondons the inlet roller 3, which is retained in withdrawn condition by the corresponding withdrawn condition of the outlet roller 15, still under the carton bottom (FIG. 14). When the lower rear corner 75 lets free the actuating portion 43 of the pairs of levers 32, on the contrary, the spring 38 suddenly urges the pair of levers 32 to come out of the outline of the casing 1 and, conveying the pivot 33 while the actuating portion 44 is kept stationary by the carton bottom, to cause the further rotation of the pair of levers 34 about the pivot 33. The result is that the cutting blade 37 carries out a sudden composed movement of rotation about the two pivots 31 and 33, that is with two lever arms which add to one another and produce double speed, and passing through the protecting bars 45 comes out of the outline of the casing 1 and of that of the pair of levers 32 to reach and cut the adhesive tape 48 between the two inlet and outlet rollers 3 and 15, thereby defining a final length of tape of prefixed length, equal to the distance between the actuating portion 43 and cutting blade 37. Between the cutting point and the unidirectional guide roller 56, on the other hand, it is defined a tape length which a suitable choice of the position of the blade 37 makes equal to that of the initial length of tape defined between the guide roller 56 and the inlet roller in the rest position of FIG. 1 and after cutting and initial arrangement as in FIG. 9. The cutting operation is illustrated in FIG. 14 and, due to the return of the roller 55, together with the pair of levers 32, from the position of FIG. 13 to that of FIG. 14, causes the loosening of the tension of the tape, the cut ends of which are allowed to position again in the most suitable way for the subsequent sealing operation.

Figure 15:
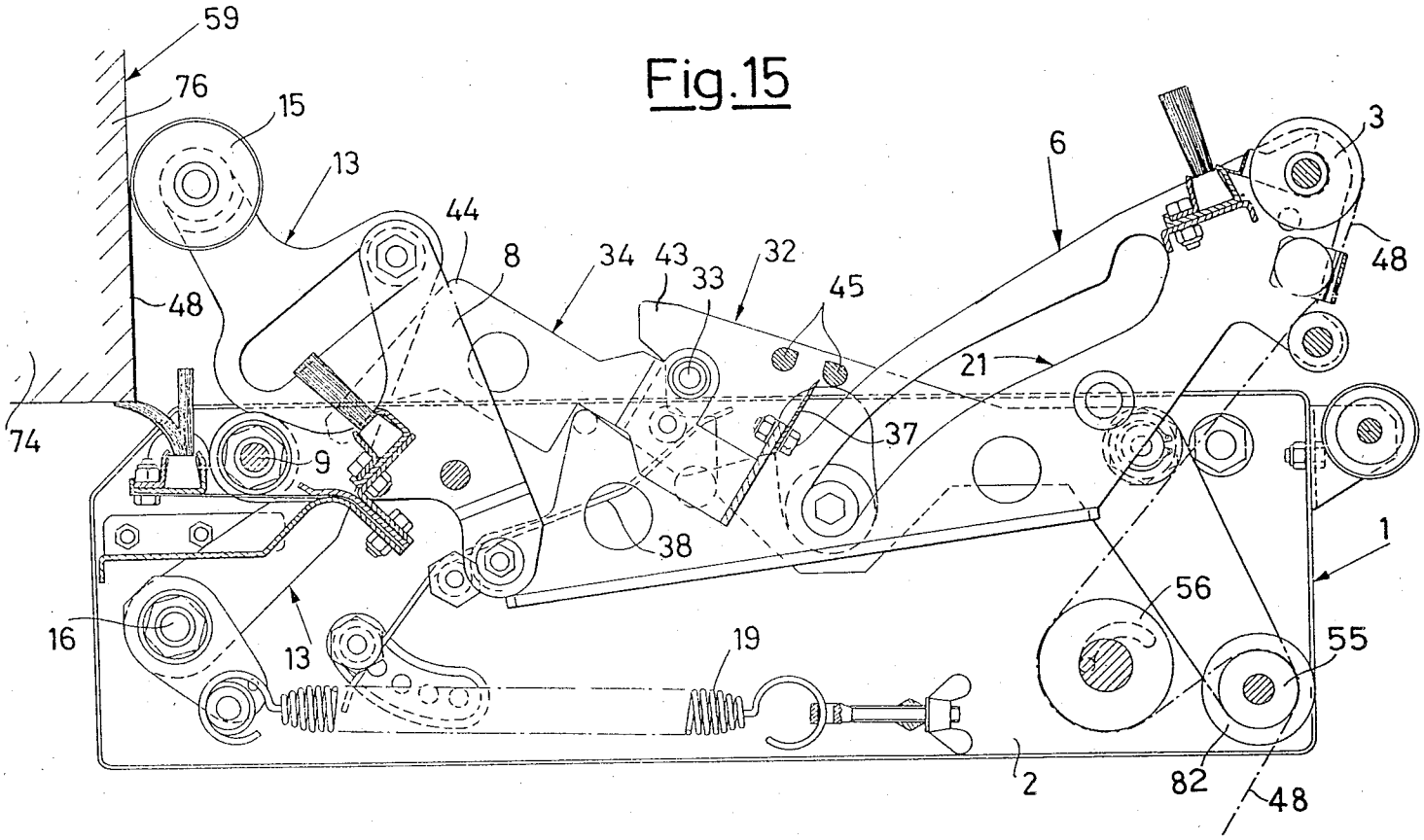

As may be understood from FIG. 15, when the carton bottom lets free the outlet roller 15, the latter is allowed to come out of the casing outline together with the inlet roller 3, and immediately after, when the carton bottom lets free the actuating portion 44 of the pair of levers 32 also, the return of the cutting blade 37 into the normal rest position, protected by the bars 45, is allowed. During its movement of coming out, the outlet roller 15 accompanies the final length of adhesive tape along the rear wall 76 of the carton, causing it to adhere corretly to the wall; to such end, the position of the fulcrum 16 and the shape of the lever arms 13 are chosen in such a way as to give the roller 15 a movement with strong horizontal component, adapted to ensure the application of the tape to the rear wall of the carton (FIG. 15), following the final advancement of the same carton. In its turn, the inlet roller 3, coming back into rest position (FIG. 15) and therefore moving away from the unidirectional roller 56, allows the initial length of the cut tape to slide on the surface of the same tape, allowing the free end of the tape to position exactly in the correct initial position of FIG. 1. The taping unit is thus ready for a new sealing operation.

While the position of the free end of the tape illustrated in FIG. 1 is correct, it may happen that tapes of different physical features, particularly of different elasticity, have a trend to allow different length of tape to unwind from the roller 49 and over all from the unidirectional roller 56, during the conveying operation carried out by the carton, which different length finally results, at the end of the operation and with no more tensiond tape, into a different, non-correct positioning of the free end on the tape of the inlet roller 3. In order to obviate this drawback, according to the type of employed tape, one acts on the adjustment system of the roller 56, more precisely on the screws 63, so as to change its position with respect to the eccentric pivot 61. In such a way, as illustrated in FIG. 6, the tape length which is, at rest, between the rollers 56 and 3 is changed so as to take into account the successive tensioning and lengthening of the tape in the step of FIG. 13.

I claim:

1. Automatic taping unit for carton sealing machines, comprising a casing adapted to be fixed to a sealing machine along the carton advancement path, an inlet applying roller and an outlet applying roller elastically urged to project from said casing to be engaged and forced to return into said casing by the front of an advancing carton, an adhesive tape supply arranged to put, at rest, a free end of the tape in contact with said inlet roller in order to be engaged and adhesively drawn forward by the carton front and further realized in such a way as to allow subsequently said tape to follow the drawing of said free end and to slide on said inlet roller to extend adhesively along the adjacent horizontal wall of the carton, and a cutting blade arranged between said inlet and outlet rollers and provided with actuating means capable of causing it to return into the outline of said casing before being reached by the carton front and to project from said outline for cutting the tape between said inlet and outlet rollers after having been overcome by the rear wall of the carton and before said horizontal wall of the carton abandons said outlet roller, characterized in that said actuating means of the cutting blade comprise first lever means pivoted on said casing and elastically urged to have an actuating portion projecting from said casing in order to be engaged and forced to return into said casing by said horizontal wall of the carton and second lever means which support said cutting blade and are pivoted on said first lever means and elastically urged with respect to the latter in such a way as to keep said cutting blade in the outline of said first lever means and to have an actuating portion projecting from said casing downstream of said actuating portion of the first lever means in the direction of advancement of the carton, the pivot between said first and second lever means being chosen in such a way that the releasing of said actuating portion of said first lever means by said horizontal wall of the carton while said actuating portion of the second lever means is still engaged by said horizontal wall of the carton causes the sudden projection of the cutting blade from the outline of said casing and said first lever means.

2. Taping unit according to claim 1, characterized in that it comprises protecting means associated to said first lever means to hidden said cutting blade when in rest position.

3. Taping unit according to claim 2, characterized in that said protecting means are constituted by horizontal rods fixed to said first lever means above said cutting blade in such a position as to prevent the access to said cutting blade when in rest position but to allow the passage of the same blade at the time of said coming out from the outline of said casing and of said first lever means.

4. Taping unit according to claim 1, characterized in that said first lever means comprise a first pair of integral levers pivoted in backward position with respect to their actuating portion and said second lever means comprise a second pair of integral levers pivoted on said first pair of lever near said actuating portion of the first pair of levers, said cutting blade being fixed to said first pair of levers in backward position with respect to said pivot between the two pair of levers.

5. Taping unit according to claim 4, characterized in that said first and second pairs of levers are resiliently urged to project from the outline of said casing by a wire spring which extends from a locking clamp to a pin fixed to said second pair of levers in slightly advanced position with respect to said pivot between the two pairs of levers.

6. Taping unit according to claim 5, characterized in that said blocking clamp is fixed to said casing in selectively variable position.

7. Taping unit according to claim 1, characterized in that said outlet roller is kinematically connected to said inlet roller in such a way as to be forced to return into the outline of said casing by the return of said inlet roller under the thrust of the front of the advancing carton and to force in its turn the coming out of said inlet roller when said outlet roller is let coming out by its overcoming by said horizontal wall of the carton, said outlet roller having a withdrawn position advanced with respect to said actuating portion of the first lever means and arranged backwards with respect to said actuating portion of the second lever means.

* * * * *